US005462799A

United States Patent [19]

Kobayashi et al.

[11] Patent Number: 5,462,799

[45] Date of Patent: Oct. 31, 1995

[54] CARBON FIBERS AND PROCESS FOR PREPARING SAME

[75] Inventors: Masanobu Kobayashi, Ehime; Motoi Itoh, Iyo; Yoji Matsuhisa, Ehime; Kazuharu Shimizu, Otsu, all of Japan

[73] Assignee: Toray Industries, Inc., Japan

[21] Appl. No.: 293,817

[22] Filed: Aug. 22, 1994

[30] Foreign Application Priority Data

| | | | |
|---|---|---|---|
| Aug. 25, 1993 | [JP] | Japan | 5-210282 |
| Jan. 14, 1994 | [JP] | Japan | 6-002582 |
| Feb. 16, 1994 | [JP] | Japan | 6-019219 |

[51] Int. Cl.[6] ..... D02G 3/00

[52] U.S. Cl. ..... 428/364; 428/367; 423/447.1

[58] Field of Search ..... 428/364, 367, 428/368, 375; 423/447.1

[56] References Cited

U.S. PATENT DOCUMENTS

| | | | |
|---|---|---|---|
| 3,832,297 | 8/1974 | Paul, Jr. . | |
| 3,914,504 | 10/1975 | Weldy | 428/367 |
| 4,364,993 | 12/1982 | Edelman et al. | 428/288 |
| 4,814,157 | 3/1989 | Uno et al. | 428/447.1 |
| 4,844,781 | 7/1989 | Sanchez et al. | 204/132 |

FOREIGN PATENT DOCUMENTS

| | | |
|---|---|---|
| 0252985 | 1/1988 | European Pat. Off. . |
| 63-85167 | 4/1988 | Japan . |
| 63-120741 | 5/1988 | Japan . |
| 1-272867 | 10/1989 | Japan . |
| 3-67143 | 10/1991 | Japan . |
| 4-44016 | 7/1992 | Japan . |
| 4-361619 | 12/1992 | Japan . |
| 2159178 | 11/1985 | United Kingdom . |

*Primary Examiner*—N. Edwards
*Attorney, Agent, or Firm*—Austin R. Miller

[57] ABSTRACT

Carbon fibers with a surface oxygen concentration (O/C ratio) of 0.20 or less as measured by X-ray photoelectron spectroscopy, a surface concentration of hydroxyl groups (C—OH/C ratio) of 0.5% or greater as measured by chemical modification X-ray photoelectron spectroscopy and a surface concentration of carboxylic groups (COOH/C ratio) of 2.0% or less as measured by chemical modification X-ray photoelectron spectroscopy, and comprising applied as a sizing agent an aliphatic compound which has multiple epoxy groups or an aromatic compound which has multiple epoxy groups, the number of atoms between the epoxy groups and an aromatic ring being 6 or greater. They are prepared by electrolyzing a carbon fiber in an alkaline aqueous solution, or electrolyzing a carbon fiber in an acidic aqueous solution followed by washing with an alkaline aqueous solution, and then applying a sizing agent of an aliphatic compound with multiple epoxy groups or an aromatic compound with multiple epoxy groups in which the number of atoms between the epoxy groups and an aromatic ring is 6 or greater. Alternatively, they are prepared by electrolyzing a carbon fiber in an aqueous solution of an ammonium salt and then applying a sizing agent of an aliphatic compound with multiple epoxy groups or an aromatic compound with multiple epoxy groups in which the number of atoms between the epoxy groups and an aromatic ring is 6 or greater.

7 Claims, No Drawings

CARBON FIBERS AND PROCESS FOR PREPARING SAME

FIELD OF THE INVENTION

The present invention relates to carbon fibers and processes for preparing them. More specifically, it relates to carbon fibers with excellent adhesion to matrices and excellent composite properties, as well as to processes for preparing them.

DESCRIPTION OF THE RELATED ART

Carbon fibers are used in composite reinforced materials with a variety of matrices, and the adhesion of the carbon fibers with a given matrix is important to exhibit their characteristics in the reinforced material.

Non-surface-treated carbon fibers generally have insufficient adhesion to matrices, and they have poor transverse properties such as delamination strength and shear strength. Consequently, after carbonization or graphitization carbon fibers are usually subjected to oxidation treatment with electrolytic oxidation, gas or liquid phase chemical oxidation, and an oxygen-containing functional groups are introduced therein for the improvement of wettability with the matrix.

In regard to the surface characteristics of carbon fibers by such oxidation treatment, in Japanese Unexamined Patent Publication (Kokai) No. 4-361619 there is a disclosed method of improving the adhesive strength of a carbon fiber to a matrix by specifying functional groups on the uppermost surface of the carbon fibers. There are also disclosed carbon fibers which are specified by not only surface oxygen concentration but also surface nitrogen concentration as measured by X-ray photoelectron spectroscopy (for example, Japanese Examined Patent Publication (Kokoku) No. 4-44016, and Japanese Unexamined Patent Publication (Kokai) No. 2-210059, 2-169763, 63-85167, and 62-276075). They do not include a study of combinations with a sizing agent. Furthermore with mere specification of the surface functional groups there have been drawbacks such as poor adhesive force with matrices, particularly with low reactive matrices.

On the other hand, because carbon fibers and graphite fibers are essentially stiff, brittle, lacking in bindability, bending ability and abrasion resistance, various types of sizing agents which prevent fluff formation and thread breakage during processing afterwards are normally added to carbon fibers to impart bindability and improve the bending ability and abrasion resistance. Thus, sizing agents have been developed and used only as pastes or binders, to improve processability, whereas virtually no research has been conducted on the use of the sizing agents for the improvement of adhesion to the matrices. Furthermore, no studies have been made regarding adaptation of the sizing agent to the surface characteristics, such as functional groups on the surface of the above mentioned carbon fibers, to improve overall characteristics of composites, including adhesion and tensile strength.

Since at the present time the most popular matrices for carbon fiber-reinforced composite materials are epoxy resins, sizing agents are usually epoxy resins or modified epoxy resins, representatives of which are bisphenol A diglycidyl ether-type epoxy resins, as aromatic compounds structurally related to the matrix, (for example, Japanese Examined Patent Publication (Kokoku) No. 4-8542, Japanese Unexamined Patent Publication (Kokai) No. 1-272867, and Japanese Examined Patent Publication (Kokoku) Nos. 62-56266 and 57-15229).

The application of linear epoxy compounds, which have no aromatic rings, as sizing agents has been disclosed in Japanese Examined Patent Publication (Kokoku) Nos. 60-47953 and 3-67143. In addition, Japanese Examined Patent Publication (Kokoku) No. 63-14114 discloses the use of a specific polyol polyglycidyl ether compound as a sizing agent to improve the bindability and interlaminar shear strength. However, by specifying only the sizing agent, there has not been sufficient adhesive force with a matrix, particularly in the case of low reactive matrices.

Regarding the composition of sizing agents, studies have also been made regarding resin systems incorporating other components such as polyurethane, etc., in the above mentioned epoxy resins, for the purpose of improving processability including bindability (for example, Japanese Examined Patent Publication (Kokoku) Nos. 1-20270 and 59-14591, and Japanese Unexamined Patent Publication (Kokai) No. 57-47920).

On the other hand, electrolytic oxidation is most generally used industrially as the method of oxidation to obtain the above mentioned specific surface characteristics. As electrolytes for this electrolytic oxidation there have been proposed aqueous solutions of various acids, alkalis or their salts.

For electrolytic treatment in an alkaline aqueous solution, it is said to be most suitable to use an inorganic strong alkali substance such as sodium hydroxide, in consideration of the effectiveness of the treatment and preventing corrosion of equipments (Japanese Unexamined Patent Publication (Kokai) Nos. 56-53275 and 61-275469). There has also been a disclosed electrolytic treatment using an organic strong alkali electrolyte containing no metal elements (Japanese Examined Patent Publication (Kokoku) No. 3-50029).

In addition, there has been a disclosed method of alkali washing after acid electrolytic treatment of carbon fibers (Japanese Unexamined Patent Publication (Kokai) No. 61-124674).

Methods using basic ammonium salt compounds or the like as electrolytes, as techniques for introducing nitrogenous functional groups such as amino groups and amide groups onto carbon fibers, are disclosed in U.S. Pat. Nos. 3,822,297 and 4,844,781 and Japanese Examined Patent Publication (Kokoku) No. 2-42940. However, since different matrices have different reactivities with carbon fibers, mere specification of the surface treatment does not always provide excellent adhesion properties.

Furthermore, in Japanese Unexamined Patent Publication (Kokai) No. 63-12074 there are disclosed carbon fibers whose functional group is a metal salt. However, while metal salts stimulate the reactivity of epoxy compounds, they are not preferred because of the problems of inactivating certain curing agents and lowering high temperature characteristics of composites.

Methods of electrolytic polymerization of epoxy compounds onto carbon fibers are also being studied (Japanese Examined Patent Publication (Kokai) Nos. 1-45490 and 1-45489), and improvements in bindability and adhesion have been disclosed. However, in addition to reaction of the carbon fibers with the epoxy compound during the electrolytic polymerization, polymerization between the epoxy compounds also occurs. Consequently, with treatment solution thus contaminated with these polymers, it is difficult to control the reaction and uniform treatment cannot be effected. Furthermore, there is a risk of these polymers adhering as impurities on the surface of the carbon fibers and thus inhibiting adhesion, and this limits any improvements in the adhesive force. An additional problem is stability of the treatment solution in cases where the treatment solution exhibits acidity or alkalinity, in that opening reactions of epoxy rings of the epoxy compound occurs.

DESCRIPTION OF THE INVENTION

The objective of the present invention is to provide carbon fibers with excellent adhesion to matrices and excellent composite characteristics, which has not been possible according to prior arts, as well as processes for preparing them.

The carbon fibers according to the present invention are characterized in that a specific functional group capable of binding with one end of a specific sizing agent is produced on the surface of the carbon fibers, and the other end of the sizing agent is made capable of binding to a matrix, to prepare composites in which the carbon fibers and the matrix are coupled by the sizing agent. In this manner, it is possible to achieve a high adhesive force between the carbon fibers and the matrix.

Furthermore, for a coupling effect by the sizing agent, it is not sufficient, as the prior art teaches, simply to have functional groups on the surface of the carbon fibers, but rather it is essential that O/C or COOH/C ratio should be lower than a given value, and that the COH/C or N/C ratio should be greater than a given value.

That is, as functional groups, phenolic hydroxyl or amino groups have an important function for exhibiting a coupling effect, whereas functional groups other than phenolic hydroxyl groups, e.g. carboxyl groups, ketone groups and the like, are preferably present in low amounts, and it is particularly important that there should be few carboxyl groups.

This is because, although carboxyl groups have higher reactivity with epoxy groups compared to hydroxyl groups, for two oxygen atoms to bond with a carbon atom during production of the carboxyl group, the chemical bonds of the six-membered rings of graphite crystallites on the carbon fiber surface must be broken and oxidation proceed to the broken edge portion, which results in making the carbon layer to which the carboxyl groups attach more fragile, and thus even if the carboxyl group and sizing agent are strongly bonded there is delamination in the fragile carbon layer, and consequently the resulting adhesive force between the carbon fibers and the matrix is lowered.

In contrast, since hydroxyl groups or amino groups can be provided without breaking a bond of the six-membered ring of graphite crystallites on the carbon fiber surface, if bonded with a sizing agent a high adhesive force between the carbon fibers and matrix is exhibited.

In addition, the sizing agent to be bonded to the surface of the carbon fibers must be one with a high reactivity, because it must react with a hydroxyl group or amino group which has a lower reactivity than a carboxyl group. Consequently, it is essential that the sizing agent includes plural reactive epoxy rings, and most effective here is an aliphatic compound or an aromatic compound with a large distance between the epoxy group and an aromatic ring, to minimize effects such as the steric hindrance due to aromatic rings.

On the other hand, a higher adhesive force between carbon fibers and a matrix is connected with lower tensile strength of their composites, because tensile fracture of the composite tends to be more brittle. Sizing agents with high toughness are effective to minimize this trade-off relationship between adhesive force and tensile strength, and thus long chain aliphatic compounds or aromatic compounds are more effective. Therefore, it is preferable to use an aliphatic compound or an aromatic compound with a large distance between the epoxy group and an aromatic ring, for less of the effect of steric hindrance by the aromatic ring, and a structure with a long chain.

The carbon fibers according to the present invention should have a surface oxygen concentration (O/C ratio) of 0.20 or less, preferably 0.15 or less and more preferably 0.10 or less, as measured by X-ray photoelectron spectroscopy. If the O/C ratio is greater than 0.20, an oxide layer with a much lower strength than the original carbon fiber substance itself will cover the carbon fiber surface, and thus even with strengthened chemical bonding between the functional groups of a resin and the upper surface of the carbon fibers, the resulting composite will have inferior transverse properties.

The lower limit of the O/C ratio should be 0.02 or greater, preferably 0.04 or greater and more preferably 0.06 or greater. If the O/C ratio is less than 0.02, the reactivity and reacting amount with the sizing agent will be too low, which will sometimes result in poor improvement in the transverse properties of the composite.

One example of the carbon fibers according to the present invention are carbon fibers with O/C ratio set to within a specific range as measured by the above X-ray photoelectron spectroscopy, with the surface concentration of hydroxyl groups (C—OH/C ratio) set to 0.5% or greater and the surface concentration of carboxyl groups (COOH/C ratio) set to 2.0% or less, as measured by chemical modification X-ray photoelectron spectroscopy. If the C—OH/C ratio is less than 0.5%, the reactivity and reacting amount with the sizing agent will be too low, which will result in poor improvement in the transverse properties of the composite.

The upper limit of the C—OH/C ratio should be 3.0%. or less, preferably 2.5% or less, and more preferably 2.0% or less. If the C—OH/C ratio is greater than 3%, the reactivity and reacting amount with the sizing agent will be excessive, making further improvement in the adhesive properties impossible and often lowering the tensile strength of the composite.

In cases where the COOH/C ratio exceeds 2.0%, similar to when the O/C ratio exceeds 0.2, an oxide layer with a much lower strength than the original carbon fiber substance itself will cover the carbon fiber surface, and thus the resulting composite will have inferior transverse properties. An additional problem is that the curing rate of the matrix resin is slowed.

The lower limit of the COOH/C ratio should be 0.2% or greater, and preferably 0.5% or greater. If the COOH/C ratio is less than 0.2%, the reactivity and reacting amount with the sizing agent will be too low, and this will sometimes result in poor improvement in the transverse properties of the composite.

Another example of the carbon fibers according to the present invention has the O/C ratio set to within a specific range as measured by the above X-ray photoelectron spectroscopy, with the surface nitrogen concentration (N/C ratio) set to 0.02 or greater, preferably 0.03 or greater, and more preferably 0.04 or greater, as measured by X-ray photoelectron spectroscopy. If the N/C ratio of carbon fibers is less than 0.02, then it will be impossible to improve the reactivity with the specific sizing agents mentioned below, and they will exhibit no effect of improvement in the transverse properties of the composite.

The upper limit of the N/C ratio should be 0.30 or less, preferably 0.25 or less and more preferably 0.20 or less. If the N/C ratio exceeds 0.3, the reactivity and reacting amount with the sizing agent will be excessive, making further improvement in the adhesive properties impossible and often lowering the tensile strength of the composite.

The nitrogen concentration on the surface of the carbon fibers is particularly important for improving adhesion, while the nitrogen concentration in the interior of the carbon fibers has virtually no effect on improvement of the adhesion. Strictly speaking, then, the nitrogen concentration of concern here is that calculated by subtracting the average nitrogen concentration in the bulk of the carbon fibers as measured by elemental analysis, from the surface nitrogen concentration, and this value should be 0 or greater, preferably 0.01 or greater, and more preferably 0.02 or greater.

The carbon fibers of the present invention have the above surface characteristics, and have a compound with the specific structure described below as a sizing agent. According to the present invention, an aliphatic compound with multiple epoxy groups may be used as the sizing agent. "Aliphatic compound" as used according to the present invention refers to a compound with a linear structure, i.e. a non-cyclic linear saturated hydrocarbon, branched saturated hydrocarbon, non-cyclic linear unsaturated hydrocarbon or branched unsaturated hydrocarbon, or any of the above hydrocarbons, one or more of whose carbon atoms ($CH_3$, $CH_2$, CH or C) have been replaced by an oxygen atom (O), a nitrogen atom (NH, N), a sulfur atom ($SO_3H$, SH) or a carbonyl atom group (CO).

Also, in the aliphatic compound with multiple epoxy groups, the longest atomic chain is the largest atomic chain of the total number of carbon atoms and other atoms (oxygen atoms, nitrogens atom, etc.) making up the linear structure which links two epoxy groups, and the total number is the number of atoms in the longest atomic chain. The number of atoms, such as hydrogen atoms, which connect to the longest atomic chain was not counted as the total number.

The side-chain structure is not particularly limited, but in order to avoid too much intermolecular crosslinking of the sizing agent compound, the structure is preferably one with few crosslinking sites.

If the sizing agent compound has less than 2 epoxy groups, it will be impossible to effectively bridge the carbon fibers and the matrix resin. Consequently, the number of epoxy groups must be 2 or more for effective bridging between the carbon fibers and the matrix resin.

On the other hand, if there are too many epoxy groups, the density of intermolecular crosslinking of the sizing agent compound will become too great, creating a brittle sizing layer and resulting in lower tensile strength of the composite; consequently the number of epoxy groups is preferably 6 or less, more preferably 4 or less, and even more preferably 2. The two epoxy groups are preferably at both ends of the longest atomic chain. That is, having epoxy groups at both ends of the longest atomic chain prevents the local crosslinking density from increasing too much, and is thus preferred for the tensile strength of the composite.

The structure of the epoxy groups preferably is that of a glycidyl group which is quite reactive.

The molecular weight of the aliphatic compound to be used is preferably 80–3200, more preferably 100–1500 and even more preferably 200–1000, from the point of view to prevent deterioration of the handleability of carbon fibers due to resin viscosity which is too low or too high.

As concrete examples of aliphatic compounds with multiple epoxy groups according to the present invention, there may be mentioned, as diglycidyl ether compounds, ethylene glycol diglycidyl ether and polyethylene glycol diglycidyl ethers, propylene glycol diglycidyl ether and polypropylene glycol diglycidyl ethers, 1,4-butanediol diglycidyl ether, neopentyl glycol diglycidyl ether, polytetramethylene glycol diglycidyl ethers, polyalkylene glycol diglycidyl ethers, etc. In addition, as polyglycidyl ether compounds there may be mentioned glycerol polyglycidyl ether, diglycerol polyglycidyl ether, polyglycerol polyglycidyl ethers, sorbitol polyglycidyl ethers, arabitol polyglycidyl ethers, trimethylolpropane polyglycidyl ethers, pentaerythritol polyglycidyl ethers, polyglycidyl ethers of aliphatic polyhydric alcohols, etc.

Preferred are aliphatic polyglycidyl ether compounds having glycidyl groups with high reactivity. More preferred are polyethylene glycol diglycidyl ethers, polypropylene glycol diglycidyl ethers, alkanediol diglycidyl ethers and compounds with the structures represented by the following formulae [II], [III] and [IV];

$$G-O-(R_1-O)_m-G \quad [II]$$

$$G-O-(R_2)_n-O-G \quad [III]$$

$$\begin{array}{l} CH_2-O-(R_1-O)_x-R_3 \\ | \\ CH-O-(R_1-O)_y-R_4 \\ | \\ CH_2-O-(R_1-O)_z-R_5 \end{array} \quad [IV]$$

wherein G represents a glycidyl group; $R_1$ represents —$CH_2CH_2$—, —$CH_2CH_2CH_2$— or —$CH(CH_3)CH_2$—; $R_2$ represents —$CH_2$—; at least two of $R_3$, $R_4$ and $R_5$ are —G, the other being —H or —G; m is an integer 1–25; n is an integer 2–75; and x, y and z are each 0 or a positive integer and x+y+z=0–25. Mixtures of the above may also be used.

The number of atoms in the longest atomic chain in the aliphatic compound with multiple epoxy groups is preferably 20 or greater. If the above number of atoms is less than 20, the density of intermolecular crosslinking in the sizing layer will become too great, creating a structure with low toughness and often resulting in poor tensile strength of the composite. In contrast, since a large number of atoms in the longest atomic chain gives the sizing layer a structure which is flexible and very tough, resulting in improved tensile strength of the composite and particularly a high tensile strength even for brittle resins. The number of atoms in the longest atomic chain is more preferably 25 or greater, and even more preferably 30 or greater.

Although a larger number of atoms in the longest atomic chain creates a more flexible structure, if it is too long bending of the long atomic chain will occur causing blockage of the functional groups on the carbon fiber surface, and sometimes resulting in reduced adhesive force between the carbon fibers and the resin; consequently the number of atoms is preferably 200 or less, and more preferably 100 or less.

In cases where the aliphatic compound contains a cyclic structure, the number of atoms may be, in practice, 6 or more if the epoxy group is sufficiently distant from the cyclic structure.

According to the present invention, an aromatic compound with multiple epoxy groups and having 6 or more atoms between the epoxy groups and aromatic ring may also be used as the sizing agent. The number of atoms between the epoxy groups and aromatic ring refers to the total number of carbon atoms and other atoms (oxygen atoms, nitrogen atoms, etc.) making up the linear structure which links an epoxy group and the aromatic ring. The linear structure in this case is the same as the linear structure described above.

If there are not at least 6 atoms between the epoxy groups and aromatic ring of the sizing agent, then this will create a stiff, sterically large compound at the interface between the carbon fibers and the matrix resin, making it difficult to improve the reactivity with the functional groups on the upper surface of the carbon fibers, and as a result no improvement in the transverse properties of the composite may be expected.

Such an aromatic compound may be one represented by the following formula [I],

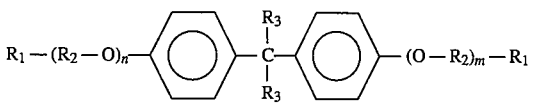

[I]

wherein $R_1$ represents the following group:

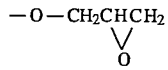

$R_2$ represents an alkylene group of 2–30 carbon atoms, $R_3$ represents —H or —$CH_3$, and m and n are each an integer of 2–48, m+n being 4–50.

In this case, in order to avoid the creation of a stiff, sterically large compound at the interface between the carbon fibers and the matrix resin, the molecular chain is preferably linear and flexible; in formula [I], m and n are each 2 or greater, preferably 3 and more preferably 5, m+n is 4 or greater, preferably 6 or greater and more preferably 10 or greater. With compounds in which m and n are each less than 2 or m+n is less than 4 the adhesion between the matrix resin and carbon fibers will sometimes be too low. On the other hand, if m+n is greater than 50 the compatibility for the matrix resin will be reduced, and this will sometimes lower the adhesion between the matrix resin and the carbon fibers.

Here, the bisphenol A portion or bisphenol F portion of formula [I] has the dual effect of both improving the compatibility for the matrix resin and improving the anti-fluff properties.

According to the present invention, the main structure of the aromatic compound with multiple epoxy groups wherein the number of atoms between the epoxy groups and an aromatic ring is 6 or greater, may be a condensed polycyclic aromatic compound. The condensed polycyclic aromatic compound structure may be, for example, naphthalene, anthracene, phenanthrene, chrysene, pyrene, naphthacene, triphenylene, 1,2-benzanthracene, benzopyrene, or the like. Naphthalene, anthracene, phenanthrene and pyrene, having small structure, are preferred.

The number of epoxy equivalents in the condensed polycyclic aromatic compound with multiple epoxy groups is preferably 150–350, and more preferably 200–300, from the point of view of preparing a product with sufficiently improved adhesion.

The molecular weight of the condensed polycyclic aromatic compound with multiple epoxy groups is preferably 400–800, and more preferably 400–600, from the point of view of preventing deterioration of the handleability of carbon fibers due to resin viscosity which is too high.

According to the present invention, for viscosity control, improved abrasion resistance, improved anti-fluff properties, improved bindability and improved processability of carbon fibers, there may be added other components such as low-molecular-weight bisphenolic epoxy compounds including Epikote 828 or Epikote 834, linear low-molecular-weight epoxy compounds, polyethylene glycol, polyurethane, polyester emulsifiers or surfactants.

There is also no problem with adding a rubber such as butadiene nitrile rubber, or a linear epoxy-modified elastomeric compound such as an epoxy-terminated butadiene nitrile rubber.

The amount of the sizing agent on carbon fibers is preferably 0.01 wt %–10 wt %, more preferably 0.05 wt %–5 wt % and even more preferably 0.1 wt %–2 wt % per unit weight of the carbon fibers, from the point of view of improving adhesion with the resin, while avoiding excessive consumption of the sizing agent.

The sizing agent according to the present invention is preferably uniformly coated.

That is, the thickness of the sizing layer is preferably 20–200 Å, with the maximum value of the thickness not exceeding twice the minimum value. Such a uniform sizing layer allows the coupling effect to be exhibited more effectively.

The mechanical properties of the carbon fibers according to the present invention should include a strand strength of 350 kgf/mm$^2$ or greater, preferably 400 kgf/mm$^2$ or greater, and more preferably 450 kgf/mm$^2$ or greater. In addition, the elastic modulus of the carbon fibers is preferably 22 tf/mm$^2$ or greater, more preferably 24 tf/mm$^2$ or greater, and even more preferably 28 tf/mm$^2$ or greater. If the carbon fibers have a strand strength or elastic modulus of less than 350 kgf/mm$^2$ or 22 tf/mm$^2$, respectively, then when the composite is made the desired properties as a structural material will not be obtainable.

A process for preparing the carbon fibers according to the present invention will now be explained. The surface treatment and sizing treatment of the carbon fibers is as explained below, but the polymerization, spinning and heat treatment of the carbon fibers are in no way restricted.

The starting carbon fibers to be supplied for the method according to the present invention may be publicly known polyacrylonitrile-based, pitch-based or rayon-based carbon fibers. Polyacrylonitrile-based carbon fibers are preferred since high-strength carbon fibers can be more easily obtained. A more detailed explanation is given below with reference to polyacrylonitrile-based carbon fibers.

The spinning method to be applied is preferably wet spinning, dry spinning, semi-wet spinning or the like. Wet spinning or semi-wet spinning is preferred and semi-wet spinning is more preferred to facilitate the obtaining of high-strength filaments. The spinning solution used may be a solution or suspension containing a homopolymer or copolymer of polyacrylonitrile, and removal of impurities from the polymer by filtration is important to obtain high-performance carbon fibers.

The above spinning solution is subjected to coagulation, washing, drawing and oiling to prepare the precursor filament, which is then oxidized, carbonized and if necessary graphitized, to make the carbon fibers. To obtain high-performance carbon fibers, it is important to minimize impurities such as dusts and foreign materials from the solution or the environment, thus preventing the introduction of defects in the fibers, and to raise the orientation by tensile stress. The carbonization and graphitization should be carried out at a maximum heating temperature of 1100°

C. or greater, and preferably 1400° C. or greater, to obtain the carbon fibers according to the present invention.

For carbon fibers with high strength and a high elastic modulus, fine-size fibers are preferred with a monofilament diameter of 7.5 μm or less, preferably 6 μm or less, and more preferably 5.5 μm or less. The resulting carbon fibers are then further subjected to surface treatment and sizing treatment.

The following method may be used to produce carbon fibers having the above mentioned ranges of the O/C ratio as measured by X-ray photoelectron spectroscopy, the surface concentration of hydroxyl groups (C—OH/C ratio) as measured by chemical modification X-ray photoelectron spectroscopy, and the surface concentration of carboxyl groups (COOH/C ratio) as measured by chemical modification X-ray photoelectron spectroscopy.

One method is an electrolytic treatment of the carbon fibers in an alkaline aqueous solution. The alkaline aqueous solution should be a alkaline aqueous solution with a pH of 7–14, preferably 8–14, and more preferably 10–14. The electrolyte therefor may be any one which exhibits alkalinity in an aqueous solution, and specifically there may be mentioned aqueous solutions of hydroxides such as sodium hydroxide, potassium hydroxide and barium hydroxide, ammonia, inorganic salts such as sodium carbonate, sodium hydrogen carbonate, etc., and of organic salts such as sodium acetate, sodium benzoate, etc. and the same salts with potassium, barium and other metals, as well as ammonium salts and organic compounds such as hydrazine. Preferred are inorganic alkalis such as ammonium carbonate, ammonium hydrogen carbonate or tetralkylammonium hydroxides exhibiting strong alkalinity, because they contain no alkali metals which may interfere curing the resins.

The concentration of the electrolyte solution should be 0.01–5 moles/liter, and preferably 0.1–1 mole/liter. A higher concentration results in a lower electrolytic voltage, but these ranges are optimum since the environment will be ruined by the strong odor.

The electrolyte solution temperature should be 0°–100° C., and preferably 10°–40° C. A low temperature is preferred to avoid ruining the environment by strong odor at high temperature, and it is preferably optimized based on the operating costs.

The amount of electric current is preferably optimized based on the degree of carbonization of the carbon fibers to be treated, and filaments with a high elastic modulus require a higher current. The electrolytic treatment is preferably repeated a few times, from the point of view of promoting a lower crystallinity of the surface and improving productivity, while preventing reduction in the strength of the carbon fiber substrate. Specifically, the electrizing current per electrolytic bath is preferably 5–100 coulombs/g.bath (number of coulombs per 1 gram of carbon fibers in each bath), more preferably 10–80 coulombs/g.bath, and even more preferably 20–60 coulombs/g.bath. From the point of view of keeping reduction of the crystallinity of the surface layer within an appropriate range, the total current of the electrization is preferably in the range of 5–1000 coulombs/g, and more preferably 10–500 coulombs/g.

The number of baths is preferably 2 or more, and more preferably 4 or more. From cost considerations, 10 or fewer is preferred, and this number is preferably optimized based on the current, voltage, current density, etc.

The current density per square meter of the surface of the carbon fibers in the electrolytic treatment solution is 1.5–1000 amperes/$m^2$, and preferably 3–500 amperes/$m^2$, from the point of view of effective oxidation of the carbon fiber surface and maintaining safety.

The electrolytic voltage is preferably 25 V or less, and more preferably 0.5–20 V, for safety considerations. The electrolytic treatment time should be optimized based on the electrolyte concentration, and should be from a few seconds to 10 minutes, and preferably from about 10 seconds to 2 minutes, for the viewpoint of productivity. The method of electrolytic treatment may employ a batch system or continuous system. The continuous system is preferred for higher productivity and less variation. The method of electrization may be either direct electrization wherein a current is passed through the carbon fibers by direct contact with an electrode roller, or indirect electrization wherein a current is passed through between the carbon fibers and an electrode via the electrolyte solution. Indirect electrization is preferred for less fluffing and fewer electric sparks during the electrolytic treatment.

In addition, the electrolytic treatment method may be carried out by passing the filaments once through each of the necessary number of electrolytic baths, or by passing them through a single electrolytic bath for the necessary number of times. The anode length in the electrolytic bath is preferably 5–100 mm, while the cathode length is preferably 300–1000 mm, and more preferably 350–900 mm.

The following method may be used to produce carbon fibers with the following ranges of the O/C ratio as measured by the above X-ray photoelectron spectroscopy, the surface concentration of hydroxyl groups (C—OH/C ratio) as measured by chemical modification X-ray photoelectron spectroscopy and the surface concentration of carboxyl groups (COOH/C ratio) as measured by chemical modification X-ray photoelectron spectroscopy. That is, the method may involve electrolytic treatment of the carbon fibers to be treated, using an acidic or salt aqueous solution, followed by washing with an alkaline aqueous solution.

The electrolyte in this case may be any one which exhibits acidity in an aqueous solution, for example, an inorganic acid such as sulfuric acid, nitric acid, hydrochloric acid, phosphoric acid, boric acid, carbonic acid, an organic acid such as acetic acid, butyric acid, oxalic acid, acrylic acid, maleic acid, etc. or a salt such as ammonium sulfate, ammonium hydrogen sulfate, or the like. Preferred among these for their strongly acidity are sulfuric acid and nitric acid.

The electrolyte solution concentration, electrolyte temperature, electrization current, total current, electrolytic voltage, treatment time, electrolytic treatment method and electrization method may be the same as for the electrolytic treatment in the above mentioned alkaline aqueous solution, but treatment at higher concentration and temperature is more effective for stronger oxidation.

After electrolytic treatment in the acidic aqueous solution, washing is performed with an alkaline aqueous solution.

The alkaline aqueous solution to be used as the washing solution should be alkaline, with a pH of 7–14 and more preferably 10–14. Specifically, there may be mentioned aqueous solutions of hydroxides such as sodium hydroxide, potassium hydroxide, barium hydroxide, ammonia, inorganic salts such as sodium carbonate, sodium hydrogen carbonate, etc., and organic salts such as sodium acetate, sodium benzoate, etc., and the same salts with potassium, barium and other metals, as well as ammonium salts and organic compounds such as hydrazine; preferred, however, are inorganic alkalis such as ammonium carbonate, ammonium hydrogen carbonate or tetralkylammonium hydroxides exhibiting strong alkalinity, because they contain no alkali metals which may interfere curing of resins.

The concentration of the alkali compound in the alkaline aqueous solution to be used as the washing solution is preferably adjusted for a pH in the ranges specified above, and specifically 0.01–10 moles/liter is preferred, with 0.1–2 moles/liter being more preferred. The temperature of the washing solution should be 0°–100° C., and preferably from room temperature to 60° C.

The washing may be by the dip method, spray method, etc., but the dip method is preferred for easier washing. In addition, it is further preferable to vibrate the carbon fibers with ultrasonic waves during the washing.

After the electrolytic treatment or washing treatment, water washing or drying is preferably effected. In this case, if the drying temperature is too high, the functional groups on the surface of the carbon fibers will tend to disappear due to thermal decomposition, and thus the drying is preferably carried out at as low temperature as possible; specifically the drying temperature should be 250° C. or lower, and preferably 210° C. or lower.

Carbon fibers with a surface oxygen concentration (O/C ratio) and surface nitrogen concentration (N/C) in the ranges specified above as measured by X-ray photoelectron spectroscopy, may be obtained by electrolytic treatment thereof in an aqueous solution of an ammonium salt.

The electrolyte solution in this case is an aqueous solution containing ammonium ion, and specific examples of electrolytes which may be used include, for example, ammonium nitrate, ammonium sulfate, ammonium persulfate, ammonium chloride, ammonium bromide, ammonium dihydrogen phosphate, diammonium hydrogen phosphate, ammonium hydrogen carbonate, ammonium carbonate, etc. and mixtures thereof. Ammonium sulfate, ammonium nitrate, ammonium chloride and ammonium hydrogen carbonate are preferred, with ammonium carbonate and ammonium hydrogen carbonate being particularly preferable due to their low residue on the carbon fiber surface after water washing and drying.

The preferred conditions for the electrolyte solution concentration, electrolyte temperature, electrization current, total current, electrolytic voltage, treatment time, electrolytic treatment method and electrization method are the same as for the electrolytic treatment in the above mentioned alkaline aqueous solution.

The method of applying the sizing agent is not necessarily restricted, and examples thereof include a method of immersing the fibers into the sizing agent via a roller, a method of contacting them with a roller covered with the sizing agent, and a method of spraying the sizing agent as a mist. Either batch system or continuous system may be used. Continuous system is preferred for higher productivity and less variation. The sizing agent concentration, temperature and filamentous tensile stress are preferably controlled at this time for uniform coating of the effective components of the sizing agent on the carbon fibers, within the proper range. It is further preferable to vibrate the carbon fibers with ultrasonic waves during application of the sizing agent.

The drying temperature and drying time should be adjusted depending on the coating amount, but in order to reduce the amount of time required for complete removal of the solvent used for application of the sizing agent and for drying, while preventing deterioration by heat and hardening of the carbon fiber bundles which impairs their spreadability, the drying temperature is preferably 150°–350° C., and more preferably 180°–250° C.

The solvent used for the sizing agent may be water, methanol, ethanol, dimethylformamide, dimethylacetamide, acetone, or the like. Water is preferred from the point of view of ease of handling and fire prevention. Consequently, when the sizing agent used is a compound which is insoluble or poorly soluble in water, an emulsifier, surfactant or the like should be added thereto for aqueous dispersion. Specifically, the emulsifier or surfactant used may be an anionic emulsifier such as styrene/maleic anhydride copolymer, olefin/maleic anhydride copolymer, a formalin condensate of naphthalenesulfonate, sodium polyacrylate, etc.; a cationic emulsifier such as polyethyleneimine, polyvinyl imidazoline, etc.; or a nonionic emulsifier such as nonylphenolethylene oxide addition product, polyvinyl alcohol, polyoxyethylene ether ester copolymer, sorbitan ester ethyl oxide addition product, etc. The nonionic emulsifier is preferred for less interaction with the epoxy groups.

The carbon fibers according to the present invention are combined with a matrix and used as a composite material.

The matrix to be applied in this case may be any of a variety including a thermosetting resin such as an epoxy or polyester resin, a thermoplastic resin such as a nylon or polyether ether ketone, a cement, or the like. Since the sizing agent compound contains epoxy groups, a thermosetting or thermoplastic resin with a high compatibility therefor is preferred, and an epoxy resin is particularly preferred.

Specifically, the bisphenolic epoxy used may be a commercially available one, and examples thereof are, as bisphenol A-types, Epikote 828, 1001, 1004, 1009 (Yuka-Shell), Epo-Tohto YD019, YD020, YD7019, YD7020, Phenoto YP50, YP50P (Kyoto Kasei), Epiclon 840, 850, 855, 860, 1050, 1010, 1030 (Dainihon Ink Kagaku Kogyo), etc. Bisphenol F-types include Epiclon 830 and 831 (Dainihon Ink Kagaku Kogyo), etc.

Phenol black-type epoxy resins include Epikote 152, 154 (Yuka-Shell), Dow-epoxy DEN431, 438, 439,485 (Dow Chemical) and Ciba-Geigy EPN1138, 1139 (Ciba-Geigy). Modified cresol novolac-type epoxies include, for example, Ciba-Geigy ECN1235, 1273, 1280, 1299 (Ciba-Geigy), EOCN102, 103, 104 (Nihon Kayaku) and Epiclon N660, N665, N670, N673, N680, N690, N695 (Dainihon Ink Kagaku). In addition, modified phenolic novolac-type epoxy resins may be used.

Multi-functional epoxy resins include N,N,N',N'-tetraglycidyl diaminodiphenylmethane, such as ELM434 (Sumitomo Kagaku Kogyo), MY720 (Ciba-Geigy) and YH434 (Kyoto Kasei).

Depending on the purpose, these epoxy resins may be combined to prepare epoxy resin compositions. There are no particular restrictions relating to additives or curing agents, and additives may include polyvinyl acetal resins, polyvinyl butyral resins, polyvinyl formal resins, etc., and curing agents may include diaminodiphenyl sulfone, boron trifluoride/amine chelates, imidazole compounds, dicyandiamide and urea derivatives, as well as multiple curing agents used simultaneously.

There are also no restrictions on the curing temperature, but for a notable improvement in the transverse properties of the composite, epoxy resin compositions with low reactivity toward the carbon fibers are most suitable, and the curing temperature should be 200° C. or lower, preferably 150° C. or lower. Specifically suitable for use are the 180° C.-cured epoxy resin compositions with improved heat resistance disclosed in Japanese Examined Patent Publication (Kokoku) No. 63-60056 and Japanese Unexamined Patent Publication (Kokai) No. 63-162732, and the 130° C.-cured epoxy resin composition disclosed in Japanese Examined Patent Publication (Kokoku) No. 4-80054, etc., particularly suitable being the 130° C.-cured epoxy resin composition for its low reactivity.

A more detailed description of the present invention will now be provided with reference to the Examples.

Methods used according to the present invention for measuring the various property values will be described first.

The surface oxygen concentration (O/C ratio), surface nitrogen concentration (N/C ratio), surface concentration of hydroxyl groups (C—OH/C ratio), surface concentration of carboxyl groups (COOH/C), nitrogen concentration (N/C ratio) by elemental analysis and abrasion fluff number were measured according to the following methods.

The surface oxygen concentration (O/C ratio) was determined by X-ray photoelectron spectroscopy, according to the following procedure. First, bundles of carbon fibers from which the sizing agent has been removed with a solvent are cut and spread on a stainless steel sample base, after which the spectroscopy is performed with the electron emitting angle set to 90°, MgKα1, 2 as the X-ray source, and the interior of the sample chamber kept at a vacuum degree of $1\times10^{-8}$ Torr. As compensation for the peaks accompanying the electrostatic charge during the measurement, the binding energy value of the main peak $C_{1S}$ was first matched to 284.6 eV. The area of the $C_{1S}$ peak was calculated by subtracting the linear base line in the range of 282–296 eV, and the area of the $O_{1S}$ peak was calculated by subtracting the linear base line in the range of 528–540 ev. The surface oxygen concentration (O/C ratio) was expressed as an atomic ratio calculated by dividing the ratio of the above $O_{1S}$ peak area and $C_{1S}$ peak area by the relative sensitivity factor unique to the apparatus. In this example, an ESCA-750 (product of Shimazu Seisakusho, KK.) was used, and the relative sensitivity factor of the apparatus was 2.85.

The surface nitrogen concentration (N/C ratio) was determined by X-ray photoelectron spectroscopy, according to the following procedure. First, bundles of carbon fibers from which the sizing agent has been removed with a solvent are cut and spread on a stainless steel sample base, after which spectroscopy is performed with the electron emitting angle set to 90°, MgKα1,2 as the X-ray source, and the interior of the sample chamber kept at a vacuum degree of $1\times10^{-8}$ Torr. As compensation for the peaks accompanying the electrostatic charge during the measurement, the binding energy value of the main peak $C_{1S}$ was first matched to 284.6 eV. The area of the peak was calculated by subtracting the linear base line $C_{1S}$ in the range of 282–296 eV, and the area of the $N_{1S}$ peak was calculated by subtracting the linear base line in the range of 398–410 eV. The surface nitrogen concentration (N/C ratio) was expressed as an atomic ratio calculated by dividing the ratio of the above $N_{1S}$ peak area and $C_{1S}$ peak area by the relative sensitivity factor unique to the apparatus. In this example, an ESCA-750 (product of Shimazu Seisakusho, KK.) was used, and the relative sensitivity factor of the apparatus was 1.7.

The surface concentration of hydroxyl groups (C—OH/C ratio) was determined by chemical modification X-ray photoelectron spectroscopy, according to the following procedure. First, bundles of carbon fibers from which the sizing agent has been removed with a solvent are cut and spread on a platinum sample base, and then exposed to dry nitrogen gas containing 0.04 mole/liter of anhydrous trifluoroacetate gas for 10 minutes at room temperature for chemical modification, after which the sample is mounted on an X-ray photoelectron spectrometer for spectroscopy with an electron emitting angle of 35°, AlKα1,2 as the X-ray source, and the interior of the sample chamber kept at a vacuum degree of $1\times10^{-8}$ Torr. As compensation for the peaks accompanying the electrostatic charge during the measurement, the binding energy value of the main peak $C_{1S}$ was first matched to 284.6 eV. The area of the $C_{1S}$ peak $[C_{1S}]$ was calculated by subtracting the linear base line in the range of 282–296 eV, and the area of the $F_{1S}$ peak $[F_{1S}]$ was calculated by subtracting the linear base line in the range of 682–695 eV. Also, the reactivity rate r was calculated from the $C_{1S}$ peak separation of polyvinyl alcohol chemically modified at the same time.

The surface concentration of hydroxyl groups (C—OH/C ratio) was expressed as the value calculated according to the following equation.

$$\mathrm{COH/C} = \frac{[F_{1S}]}{(3k[C_{1S}] - 2[F_{1S}])r} \times 100\ (\%)$$

The value k is the relative sensitivity factor of the $F_{1S}$ peak area with respect to the $C_{1S}$ peak area, unique to the apparatus used, and here a Model SSX-100-206, product of U.S. SSI was used, which had a relative sensitivity factor of 3.919.

The surface concentration of carboxyl groups (COOH/C ratio) was determined by chemical modification X-ray photoelectron spectroscopy, according to the following procedure. First, bundles of carbon fibers from which the sizing agent has been removed with a solvent are cut and spread on a platinum sample base, and then exposed to air containing 0.02 mole/liter of trifluoroethanol gas, 0.001 mole/liter of dicyclohexyl carbodiimide gas and 0.04 mole/liter of pyridine gas, for 8 hours at 60° C. for chemical modification, after which the specimen is mounted on an X-ray photoelectron spectrometer for spectroscopy with an electron emitting angle of 35°, AlKα1,2 as the X-ray source, and the interior of the specimen chamber kept at a vacuum degree of $1\times10^{-8}$ Torr. As compensation for the peaks accompanying the electrostatic charge during the measurement, the binding energy value of the main peak $C_{1S}$ was first matched to 284.6 eV. The area of the $C_{1S}$ peak $[C_{1S}]$ was calculated by subtracting the linear base line in the range of 282–296 eV, and the area of the $F_{1S}$ peak $[F_{1S}]$ was calculated by subtracting the linear base line in the range of 682–695 eV. Also, the reactivity rate r was calculated from the $C_{1S}$ peak separation of polyacrylic acid and the persistence rate m was calculated from the $O_{1S}$ peak separation of a dicyclohexyl carbodiimide derivative, which were chemically modified at the same time.

The surface concentration of carboxyl groups (COOH/C ratio) was expressed as the value calculated according to the following equation.

$$\mathrm{COOH/C} = \frac{[F_{1S}]}{(3k[C_{1S}] - (2 + 13m)[F_{1S}])r} \times 100\ (\%)$$

The value k is the relative sensitivity factor of the $F_{1S}$ peak area with respect to the $C_{1S}$ peak area, unique to the apparatus used, and here a Model SSX-100-206, product of U.S. SSI was used, which had a relative sensitivity factor of 3.919.

The average nitrogen concentration determined by elemental analysis was calculated according to the following method. First, about 20 mg of a carbon fiber bundle prior to sizing treatment was washed with a solvent to remove impurities attached to the surface of the fibers, and the measurement was made using a CHN coder.MT-3 apparatus manufactured by Yanagimoto Seisakusho, under the following conditions.

The temperature of the sample combustion reactor of the CHN coder is raised to 950° C., the oxidation reactor to 850° C. and the reduction reactor to 550° C., helium is fed in at a flow rate of 180 ml/min, and the above washed carbon fibers are accurately weighed out and placed in the above sample combustion reactor.

A suction pump was used to draw a portion of the cracked gas in the above specimen burner reactor for about 5 minutes via the oxidation reactor and the reduction reactor, after which the nitrogen-to-carbon weight ratio was determined by quantitative analysis of the amounts of $N_2$ using the thermal conductive detector of the CHN coder. The average nitrogen concentration was then determined based on the obtained weight ratio converted to an atomic ratio.

The abrasion fluff number was determined in the following manner. First, an abrasion device was used in which 5 stainless steel rods (chrome-plated, surface roughness $1-1.5^S$) of 10 mm in diameter had been arranged parallel to each other spaced 50 mm apart, in a zig-zag manner so as to allow the carbon fibers to contact their surface at a contact angle of 120°. This device was used to exert a tensile stress on the carbon fiber filaments of 0.09 g per denier at the feeding side, with a filament feeding rate of 3 m/min, the side of the fiber filaments was irradiated with laser light at a 90° angle, and the number of fluffs was detected and counted with a fluff detector, and expressed as a number per meter.

The tensile properties of the carbon fibers according to the present invention were determined by measuring the tensile strength of the strands, the elastic modulus and the tensile strength of the composite. The transverse properties of the composite, i.e. the index of adhesion between the carbon fibers and the matrix, were determined by measuring edge delamination strength (EDS) and interlaminar shear strength (ILSS).

The influence on Charpy impact properties was also investigated.

The strand tensile strength and elastic modulus were determined in the following manner. The measurement was made according to the JIS-R-7601 resin-impregnated strand test. The resin formula used was Bakelite (registered trademark of Union Carbide) ERL4221/monoethylamino borotrifluoride/acetone=100/3/4 (parts by weight), and the curing conditions were normal pressure, 130° C., 30 minutes. Ten strands were measured, and the average value thereof was calculated.

The following 2 types of resins, A and B, were used as the resins for evaluation of the composite properties.

Resin A was prepared in the following manner, as disclosed in Example 1 of Japanese Examined Patent Publication (Kokoku) No. 4-80054. That is, 3.5 kg (35 parts by weight) of Epikote 1001 manufactured by Yuka-Shell, 2.5 kg (25 parts by weight) of Epikote 828 manufactured by Yuka-Shell, 3.0 kg (30 parts by weight) of Epiclon N740 manufactured by Dainihon Ink Kagaku Kogyo, 1.5 kg (15 parts by weight) of Epikote 152 manufactured by Yuka-Shell, 0.8 kg (8 parts by weight) of Denkaformal #20 manufactured by Denki Kagaku Kogyo and 0.5 kg (5 parts by weight) of dichlorophenyl dimethyl urea were combined and stirred for 30 minutes to obtain a resin composition. This was used to coat release paper which was then used as a resin film.

The curing was carried out for 2 hours under a pressure of 3 kgf/cm$^2$.G and at 135° C.

Resin B was prepared in the following manner, as disclosed in Example 1 of Japanese Examined Patent Publication (Kokoku) No. 63-60056. That is, 6.0 kg (60 parts by weight) of ELM434 manufactured by Sumitomo Kagaku, 3.0 kg (30 parts by weight) of Epikote 825 manufactured by Yuka-Shell, 1.0 kg (10 parts by weight) of Epiclon 830 manufactured by Dainihon Ink Kagaku Kogyo and 1.75 kg (17.5 parts by weight) of polyether sulfone were heated and stirred together at 150° C. for 30 minutes, to obtain a transparent viscous solution. This composition was then cooled to 60° C., and 4.6 kg (46 parts by weight) of diaminodiphenylsulfone was uniformly dispersed therein to obtain a resin composition. This was used to coat release paper which was then used as a resin film.

The curing was carried out for 2 hours under a pressure of 6 kgf/cm$^2$.G and at 180° C.

Composite specimens were prepared in the following manner. First, a steel drum with a circumference of about 2.7 m was used for winding of a resin film prepared by coating silicone-applied paper with the resin to be combined with the carbon fibers, and then carbon fibers drawn from a creel were wound neatly around the above resin film via a traverse, and after the above resin film was further laid over the fibers, the resin was impregnated into the fibers by rotary pressure from a press roll, to prepare a unidirectional pre-preg 300 mm wide and 2.7 m long.

At this time, for better impregnation of the resin in between the fibers, the drum was heated to 60°–70° C. and the revolution of the drum and the feeding rate of the traverse were adjusted to prepare a pre-preg with a fiber weight of about 200 g/m$^2$ and a resin amount of about 35 wt %.

The pre-preg obtained in this manner was cut and layered in a structure (+25°/−25°/+25°/−25°/90°)s for EDS, and then an autoclave was used for heat curing under specified curing conditions to prepare a cured panel about 2 mm in thickness. For the ILSS and tensile strength tests, the pre-preg was layered in the same direction, to prepare unidirectional cured panels about 2 mm and 1 mm in thickness, respectively.

The EDS specimens were cut to a width of 25.4 mm and a length of 230 mm, and the measurement was carried out using a conventional tension testing apparatus with a gauge length of 127 mm and a cross head speed of 1 mm/min. The edge delamination strength was determined by the load at the start of interlaminar delamination on the specimen side edges. Five specimens were measured and the average of them was taken.

The ILSS specimens were cut to a width of 12.7 mm and a length of 28 mm, and the measurement was carried out using a conventional 3-point flexural testing apparatus with a support span of 4 times the specimen thickness and a strain rate of 2.5 mm/min. Eight specimens were measured and the average of them was taken.

The tensile strength specimens were cut to a width of 12.7 mm and a length of 230 mm, GFRP tabs of 1.2 mm thick and 50 mm long were stuck on both ends of the specimens (when necessary, strain gauges were pasted onto the center of the specimen to measure the elastic modulus and breaking strain), and the measurement was made with a crosshead speed of 1 mm/min. Five specimens were measured and the average of them was taken.

A unidirectional cured panel with a thickness of about 6 mm was prepared by the same method as for the ILSS and tensile strength specimens, to be used for Charpy impact test. The specimens were unnotched, 10 mm wide and 60 mm long.

The Charpy impact testing apparatus used was a standard type weighing 30 kgf.m (product of Yonekura Seisakusho) and equipped with a load sensor on the back of the striking section thereof. Thus, the output from the amplifier of the load sensor was fed to a personal computer via a waveform digital memory, and measurement was made of the maximum load and the amount of energy absorbed up to the maximum load. The striking direction was flat-wise, and the distance between supporting points was 40 mm. 10 specimens were measured and the average of them was taken.

EXAMPLE 1

A copolymer consisting of 99.4 mole % of acrylonitrile and 0.6 mole % of methacrylic acid was subjected to semi-wet spinning to obtain acrylic fibers with 1 denier monofilaments and a filament count of 12,000. The resulting fiber bundle was then heated in 240°–280° C. air with a stretch ratio of 1.05 and converted to flame-resistant fibers, and then the temperature was elevated at 200° C./min within a temperature range of 300°–900° C. in a nitrogen atmosphere with 10% stretching, after which carbonization was performed up to 1300° C.

An aqueous solution of tetraethylammonium hydroxide (TEAH) at a concentration of 0.1 mole/liter was used as the electrolyte solution. Electrizing current was 10 coulombs/g.bath for each bath, and the treatment was repeated 4 times using 4 baths for treatment of the above carbon fibers with a total current of 40 coulomb/g. The voltage was 12 V, and the current density was 9.5 A/m$^2$. At this time, the color of the electrolyte solution changed to gray. The carbon fibers subjected to this electrolytic treatment were then washed with water and dried in air heated to 150° C.

Next, glycerol triglycidyl ether was diluted with dimethylformamide (DMF) to 1 wt % of the resin composition for the sizing solution, the sizing solution was applied to the carbon fibers with an impregnation method, and drying was effected at 230° C. The amount of application was 0.4%.

The strand strength and elastic modulus of the carbon fibers obtained in this manner were 484 kgf/mm$^2$ and 23.8 tf/mm$^2$, respectively. Table 1 gives the results of measurement of the concentration of surface functional groups, and the tensile strength and the EDS with resin A.

EXAMPLES 2, 3 AND 4

The same procedure as in Example 1 was used to obtain carbon fibers, except that the number of treatment baths and current per bath were changed for total currents of 5, 10 and 20 coulomb/g. The results are given in Table 1.

EXAMPLE 5

The same procedure as in Example 1 was used to obtain carbon fibers, except that the electrolyte solution was changed to an aqueous solution of ammonium hydrogen carbonate with a concentration of 0.25 mole/liter. The results are given in Table 1.

Comparative Example 1

The same procedure as in Example 1 was used to obtain carbon fibers, except that the electrolyte solution was changed to an aqueous sulfuric acid solution with a concentration of 0.05 mole/liter, and the number of treatment baths and current per bath were changed for a total current of 100 coulomb/g. The results are given in Table 1.

EXAMPLES 6–9

The same procedure as in Example 1 was used to obtain carbon fibers, except that the resin component of the sizing agent was changed to glycerol diglycidyl ether, polyethylene glycol diglycidyl ether (a compound of formula [II] in which $R_1$ is —$CH_2CH_2$— and m is 9), diglycerol polyglycidyl ether or diethylene glycol diglycidyl ether. Table 2 shows the results of measurement of the concentration of surface functional groups, and the tensile strength and EDS with resin A, for the resulting carbon fibers.

EXAMPLES 10, 11

The same procedure as in Example 5 was used to obtain carbon fibers, except that the resin component of the sizing agent was changed to glycerol diglycidyl ether or polyethylene glycol diglycidyl ether (a compound of formula [II] in which $R_1$ is —$CH_2CH_2$— and m is 9). Table 2 shows the results of measurement of the concentration of surface functional groups, and the tensile strength and EDS with resin A, for the resulting carbon fibers.

Comparative Example 2

The same procedure as in Example 1 was used to obtain carbon fibers, except that for the treatment with the sizing agent the immersion was in a DMF solution containing no sizing components. The results are given in Table 2.

Comparative Examples 3 and 4

The same procedure as in Example 1 was used to obtain carbon fibers, except that the resin component of the sizing agent was changed to an aromatic ring-containing bisphenol A-type diglycidyl ether, namely Epikote 828 of Yuka-Shell (number of atoms between epoxy groups and an aromatic ring=2) or phenolic novolac-type glycidyl ether, namely Epikote 154 of Yuka-Shell (number of atoms between epoxy ring and aromatic ring=2). The results are given in Table 2.

EXAMPLE 12

A copolymer consisting of 99.4 mole % of acrylonitrile and 0.6 mole % of methacrylic acid was subjected to semi-wet spinning to obtain acrylic fibers with 1 denier monofilaments and a filament count of 12,000. The resulting fiber bundle was then heated in 240°–280° C. air with a stretch ratio of 1.05 and converted to flame-resistant fibers, and then the temperature was elevated at 200° C./min within a temperature range of 300°–900° C. in a nitrogen atmosphere for 10% stretching, after which carbonization was performed to 1800° C.

An aqueous solution of tetraethylammonium hydroxide (TEAH) at a concentration of 0.1 mole/liter was used as the electrolyte solution, the electrizing current was 40 coulombs/g.bath for each bath, and the treatment was repeated 5 times using 5 baths for treatment of the above carbon fibers with a total current of 200 coulomb/g. The voltage was 16 V, and the current density was 30 A/m$^2$. At this time, the color of the electrolyte solution changed to gray. The carbon fibers subjected to this electrolytic treatment were then washed with water and dried in air heated to 150° C.

Next, glycerol triglycidyl ether was diluted with dimethylformamide (DMF) to 1 wt % of the resin composition for the sizing solution, the sizing solution was applied to the carbon fibers by an impregnation method, and drying was effected at 230° C. The amount of the sizing agent was 0.5 wt %.

The results of measurement of the concentration of surface functional groups, and the tensile strength and EDS with resin A, for the carbon fibers obtained in this manner are given in Table 3.

Comparative Example 5

The same procedure as in Example 12 was used to obtain carbon fibers, except that the electrolyte solution was changed to an aqueous sulfuric acid solution with a concentration of 0.05 mole/liter, and for treatment with the sizing agent the immersion was in a DMF solution containing no sizing components. The results are given in Table 3.

EXAMPLE 13

The carbon fibers in Comparative Example 5 which had been electrolytically treated with the aqueous sulfuric acid solution, washed with water and dried with air heated to 150° C., were then stirred for 10 minutes in an aqueous TEAH solution with a concentration of 0.1 mole/liter. At this time, the color of the electrolyte solution changed to gray. The carbon fibers were treated thereafter in the same manner as in Comparative Example 5 except for washing and drying at 150° C. The results are given in Table 3.

EXAMPLE 14

The same procedure as in Example 13 was used to obtain carbon fibers, except that the resin component in the sizing agent was changed to glycerol diglycidyl ether. The results of measurement of the concentration of surface functional groups and the tensile strength and EDS with resin A for the resulting carbon fibers are given in Table 3.

EXAMPLE 15

A copolymer consisting of 99.4 mole % of acrylonitrile and 0.6 mole % of methacrylic acid was subjected to semi-wet spinning to obtain acrylic fibers with 0.7 denier monofilaments and a filament count of 12,000. The resulting fiber bundle was then heated in 240°–280° C. air with a stretch ratio of 1.05 and converted to flame-resistant fibers, and then the temperature was elevated at 200° C./min within a temperature range of 300°–900° C. in a nitrogen atmosphere for 10% stretching, after which carbonization was performed to 1800° C.

An aqueous solution of ammonium hydrogen carbonate with a concentration of 0.25 mole/liter was used as the electrolyte solution, the electrizing current was 20 coulombs/g.bath for each bath, and this was repeated 5 times using 5 baths for treatment of the above carbon fibers with a total current of 100 coulomb/g. The voltage was 13 V, and the current density was 15 A/m$^2$. The carbon fibers subjected to this electrolytic treatment were then washed with water and dried in air heated to 180° C.

Next, a sizing solution prepared by adding a nonionic emulsifier to glycerol triglycidyl ether in an amount of 5 wt % was diluted with water to 1 wt % of the composition for the sizing solution, the sizing solution was applied to the carbon fibers by an impregnation method, and drying was effected at 180° C. The amount of the sizing agent was 0.4 wt %.

The results of measurement of the concentration of surface functional groups, strand strength, strand elastic modulus, and the composite tensile strength and EDS with resin A for the carbon fibers obtained in the above manner are given in Table 4. The composite tensile elastic modulus was 17.1 tf/mm$^2$.

From the instrumented Charpy impact test, the amount of energy absorbed up to the maximum load was 55 kJ/m$^2$, and the maximum load was 5.2 kN.

EXAMPLE 16

The same procedure as in Example 15 was used to obtain carbon fibers, except that the electrizing current was 20 coulombs/g.bath for each bath, and the procedure was repeated 10 times for treatment of the above carbon fibers with a total current of 200 coulomb/g. The results are given in Table 4.

EXAMPLES 17–19

The same procedure as in Example 15 was used to obtain carbon fibers, except that the electrolyte solution was changed to a 0.25 mole/liter aqueous solution of ammonium carbonate, a 0.10 mole/liter aqueous solution of ammonium sulfate or a 0.10 mole/liter aqueous solution of ammonium nitrate. The results are given in Table 4.

Comparative Example 6

The same procedure as in Example 15 was used to obtain carbon fibers, except that no electrolytic treatment was performed. The results are given in Table 4.

Comparative Example 7

The same procedure as in Example 15 was used to obtain carbon fibers, except that the electrolyte solution was a 0.05 mole/liter aqueous sulfuric acid solution. The results are given in Table 4. The composite tensile elastic modulus was 17.2 tf/mm$^2$.

From the instrumented Charpy impact test, the amount of energy absorbed up to the maximum load was 46 kJ/m$^2$, and the maximum load was 4.6 kN.

Comparative Example 9

The same procedure as in Example 15 was used to obtain carbon fibers, except that the electrolyte solution was changed to a 0.10 mole/liter aqueous solution of sodium hydroxide. The results are given in Table 4.

EXAMPLES 20–31

The same procedure as in Example 15 was used to obtain carbon fibers, except that the resin component of the sizing agent was changed to glycerol diglycidyl ether, diethylene oxide diglycidyl ether, polyethylene oxide diglycidyl ether (a compound of formula [II] in which $R_1$ is —$CH_2CH_2$— and m is 9 or 30), polypropylene oxide diglycidyl ether (a compound of formula [II] in which $R_1$ is —$CH(CH_3)CH_2$— and m is 7, 9, 17 or 69), 1,6-hexanediol diglycidyl ether, alkanediol diglycidyl ether (a compound of formula [III] in which n is 12) or a compound of formula [IV] (where $R_1$ is —$CH_2CH_2$—, $R_3$, $R_4$ and $R_5$ are glycidyl groups, and x+y+z=20 or 30). The results are given in Table 5.

Comparative Example 9

The same procedure as in Example 15 was used to obtain carbon fibers, but omitting the sizing agent application step. The results are given in Table 5.

Comparative Example 10

The same procedure as in Example 15 was used to obtain carbon fibers, except that the resin component of the sizing agent was changed to lauryl monodiglycidyl ether. The results are given in Table 5.

Comparative Examples 11 and 12

The same procedure as in Example 15 was used to obtain carbon fibers, except that the resin component of the sizing agent was changed to a bisphenol A-type diglycidyl ether, namely Epikote 828 of Yuka-Shell (number of atoms between epoxy ring and aromatic ring=2) or a phenolic novolac-type glycidyl ether, namely Epikote 154 of Yuka-Shell (number of atoms between epoxy ring and aromatic ring=2). The results are given in Table 5.

EXAMPLE 32

Filaments prepared by spinning and carbonization at 1800° C. in the same manner as in Example 12, were treated using a 0.25 mole/liter aqueous solution of ammonium hydrogen carbonate as the electrolyte solution, with an electrizing current of 20 coulombs/g.bath for each bath, and this was repeated in 5 baths for treatment of the above carbon fibers with a total current of 100 coulomb/g. The carbon fibers subjected to this electrolytic treatment were then washed with water and dried in air heated to 180° C.

Next, the sizing solution was applied to the carbon fibers by impregnation of an aqueous emulsion containing 1 wt % of a sizing solution whose resin component was a compound of formula [I] in which $R_2$ was —$CH_2CH_2$—, $R_3$ was —$CH_3$, m was 15 and n was 15, and drying was effected at 180° C. The amount of the sizing agent was 0.8 wt %.

The results of measurement of the concentration of surface functional groups, abrasion fluff number, strand strength, and the composite tensile strength and EDS with resin A for the carbon fibers obtained in this manner are given in Table 6.

Also, the strand tensile elastic modulus was 30.5 tf/mm$^2$ and the ILSS was 11.8 kgf/mm$^2$. The average nitrogen concentration was 0.019.

EXAMPLES 33, 34 and 35

The same procedure as in Example 32 was used to obtain carbon fibers, except that the electrolyte solution was changed to a 0.25 mole/liter aqueous solution of ammonium carbonate, a 0.10 mole/liter aqueous solution of ammonium sulfate, or a 0.10 mole/liter aqueous solution of ammonium nitrate. The results are given in Table 6.

Comparative Example 13

The same procedure as in Example 32 was used to obtain carbon fibers, except that the electrolyte solution was changed to a 0.05 mole/liter aqueous solution of sulfuric acid. The results are given in Table 6. Strand tensile elastic modulus was 30.5 tf/mm$^2$ and ILSS was 10.8 kgf/mm$^2$.

Comparative Example 14

The same procedure as in Example 32 was used to obtain carbon fibers, except that the electrolyte solution was changed to a 0.10 mole/liter aqueous solution of sodium hydroxide. The results are given in Table 6.

EXAMPLE 36

The same procedure as in Example 32 was used to obtain carbon fibers, except that the aqueous emulsion used contained 1 wt % of a sizing agent whose resin component was a compound of formula [I] in which $R_2$ was — $CH_2CH_2$—, $R_3$ was —$CH_3$ and m and n were both 2. The results are given in Table 7. The O/C ratio was 0.10 and the N/C ratio was 0.02.

EXAMPLES 37–40

The same procedure as in Example 32 was used to obtain carbon fibers, except that the sizing agent used was a compound of formula [I] in which $R_2$ was —$CH_2CH_2$—, $R_3$ was —$CH_3$ and m and n were both 5; a compound of formula [I] in which $R_2$ was —$CH_2CH_2$—, $R_3$ was —$CH_3$ and m and n were both 10; a compound of formula [I] in which $R_2$ was — $CH_2CH_2$—, $R_3$ was —H and m and n were both 15; or a compound of formula [I] in which $R_2$ was —$CH_2CH_2$—, $R_3$ was —$CH_3$ and m and n were both 30. The results are given in Table 7. The O/C ratio was 0.10 and the N/C ratio was 0.02.

Comparative Example 15

The same procedure as in Example 32 was used to obtain carbon fibers, except that the aqueous emulsion used contained 1 wt % of a sizing agent whose resin component was a compound of formula [I] in which $R_1$ was —OH, $R_2$ was —$CH_2CH_2$—, $R_3$ was —$CH_3$ and m and n were both 15. The results are given in Table 7. The O/C ratio was 0.10 and the N/C ratio was 0.02. Strand tensile elastic modulus was 30.5 tf/mm$^2$ and ILSS was 10.9 kgf/mm$^2$.

Comparative Example 16

The same procedure as in Example 32 was used to obtain carbon fibers, except that the aqueous emulsion used contained 1 wt % of a sizing agent whose resin component was a compound of formula [I] in which $R_2$ was — $CH_2CH_2$—, $R_3$ was —$CH_3$ and m and n were both 1. The results are given in Table 7. The O/C ratio was 0.10 and the N/C ratio was 0.02.

EXAMPLE 41

The same procedure as in Example 32 was used to obtain carbon fibers, except that 1,6-naphthalene polyethylene oxide (6 molar addition) diglycidyl ether was diluted with dimethylformamide (DMF) to 1 wt % of the resin composition to adjust the mother liquor of the sizing solution, the sizing solution was applied to the carbon fibers by an impregnation method, and drying was effected at 230° C. The results are given in Table 8. The O/C ratio was 0.10 and the N/C ratio was 0.03.

Comparative Example 17

The same procedure as in Example 41 was used to obtain carbon fibers, except that the electrolyte solution was a 0.05 mole/liter aqueous solution of sulfuric acid. The results are given in Table 8. The O/C ratio was 0.15 and the N/C ratio was 0.01.

EXAMPLE 42

The same procedure as in Example 1 was used to obtain carbon fibers, except that resin component used for the sizing agent was a compound of formula [I] in which $R_2$ was —$CH_2CH_2$—, $R_3$ was —$CH_3$ and m and n were both 15. The results of measurement of the composite tensile strength and EDS with resin A are given in Table 9.

EXAMPLE 43

The carbon fibers obtained in Example 1 were subjected to measurement of the composite tensile strength and EDS with resin B. The results are given in Table 9.

EXAMPLES 44–46

The carbon fibers obtained in Examples 6, 7 and 42 were subjected to measurement of the composite tensile strength and EDS with resin B. The results are given in Table 9.

Comparative Example 18

The carbon fibers obtained in Comparative Example 2 were subjected to measurement of the composite tensile strength and EDS with resin B. The results are given in Table 9.

TABLE 1

| Specimen | Electrolyte | Times | Current per bath C/g | Total current C/g | Sizing component | Amount % | O/C | COH/C % | COOH/C % | Strand strength kgf/mm$^2$ | Composite tensile strength kgf/mm$^2$ | EDS kgf/mm$^2$ |
|---|---|---|---|---|---|---|---|---|---|---|---|---|
| Example 1 | TEAH | 4 | 10 | 40 | Glycerol triglycidyl ether | 0.4 | 0.14 | 1.3 | 0.7 | 484 | 230 | 32 |
| Example 2 | TEAH | 1 | 10 | 10 | Glycerol triglycidyl ether | 0.2 | 0.10 | 0.9 | 0.8 | 492 | 237 | 28 |
| Example 3 | TEAH | 2 | 10 | 20 | Glycerol triglycidyl ether | 0.2 | 0.12 | 1.1 | 0.6 | 490 | 235 | 30 |
| Example 4 | TEAH | 1 | 5 | 5 | Glycerol triglycidyl ether | 0.2 | 0.06 | 0.6 | 0.4 | 491 | 236 | 28 |
| Example 5 | $NH_4HCO_3$ | 4 | 10 | 40 | Glycerol triglycidyl ether | 0.4 | 0.15 | 0.6 | 1.0 | 486 | 233 | 30 |
| Comparison 1 | Sulfuric acid | 10 | 10 | 100 | Glycerol triglycidyl ether | 0.5 | 0.24 | 0.4 | 3.0 | 470 | 228 | 19 |

TABLE 2

| Specimen | Electrolyte | Times | Current per bath C/g | Total current C/g | Sizing component | Amount % | O/C | COH/C % | COOH/C % | Strand strength kgf/mm$^2$ | Composite tensile strength kgf/mm$^2$ | EDS kgf/mm$^2$ |
|---|---|---|---|---|---|---|---|---|---|---|---|---|
| Example 1 | TEAH | 4 | 10 | 40 | Glycerol triglycidyl ether | 0.4 | 0.14 | 1.3 | 0.7 | 484 | 230 | 32 |
| Example 6 | TEAH | 4 | 10 | 40 | Glycerol diglycidyl ether | 0.4 | 0.14 | 1.3 | 0.7 | 490 | 238 | 33 |
| Example 7 | TEAH | 4 | 10 | 40 | Polyethylene oxide diglycidyl ether (m in formula [II] is 9) | 0.4 | 0.14 | 1.3 | 0.7 | 491 | 242 | 32 |
| Example 8 | TEAH | 4 | 10 | 40 | Diglycerol polyglycidyl ether | 0.5 | 0.14 | 1.3 | 0.7 | 472 | 229 | 29 |
| Example 9 | TEAH | 4 | 10 | 40 | Diethylene glycol diglycidyl ether | 0.3 | 0.14 | 1.3 | 0.7 | 492 | 242 | 33 |
| Example 5 | $NH_4HCO_3$ | 4 | 10 | 40 | Glycerol triglycidyl ether | 0.4 | 0.15 | 0.6 | 1.0 | 480 | 224 | 30 |
| Example 10 | $NH_4HCO_3$ | 4 | 10 | 40 | Glycerol diglycidyl ether | 0.4 | 0.15 | 0.6 | 1.0 | 489 | 237 | 30 |
| Example 11 | $NH_4HCO_3$ | 4 | 10 | 40 | Polyethylene oxide diglycidyl | 0.4 | 0.15 | 0.6 | 1.0 | 490 | 239 | 30 |

TABLE 2-continued

| Specimen | Electrolyte | Times | Current per bath C/g | Total current C/g | Sizing component | Amount % | O/C | COH/C % | COOH/C % | Strand strength kgf/mm$^2$ | Composite tensile strength kgf/mm$^2$ | EDS kgf/mm$^2$ |
|---|---|---|---|---|---|---|---|---|---|---|---|---|
| | | | | | ether (m in formula [II] is 9) | | | | | | | |
| Comparison 2 | TEAH | 4 | 10 | 40 | | — | 0.14 | 1.3 | 0.7 | 481 | 231 | 24 |
| Comparison 3 | TEAH | 4 | 10 | 40 | Epikote 828 | 0.4 | 0.14 | 1.3 | 0.7 | 485 | 233 | 25 |
| Comparison 4 | TEAH | 4 | 10 | 40 | Epikote 154 | 0.4 | 0.14 | 1.3 | 0.7 | 482 | 230 | 25 |

TABLE 3

| Specimen | Electrolyte | Times | Current per bath C/g | Total current C/g | Washing solution | Sizing component | Amount % | O/C | COH/C % | COOH/C % | Strand strength kgf/mm$^2$ | Composite tensile strength kgf/mm$^2$ | EDS kgf/mm$^2$ |
|---|---|---|---|---|---|---|---|---|---|---|---|---|---|
| Example 12 | TEAH | 5 | 40 | 200 | — | Glycerol triglycidyl ether | 0.5 | 0.10 | 0.9 | 0.6 | 480 | 229 | 26 |
| Example 13 | Sulfuric acid | 5 | 40 | 200 | TEAH | Glycerol triglycidyl ether | 0.4 | 0.14 | 0.5 | 1.7 | 475 | 233 | 22 |
| Example 14 | Sulfuric acid | 5 | 40 | 200 | TEAH | Glycerol diglycidyl ether | 0.4 | 0.14 | 0.5 | 1.7 | 484 | 235 | 23 |
| Comparison 5 | Sulfuric acid | 5 | 40 | 200 | — | Glycerol triglycidyl ether | 0.4 | 0.15 | 0.4 | 2.0 | 475 | 239 | 17 |

TABLE 4

| Specimen | Electrolyte | Current C/g | Amount % | O/C | N/C | Strand strength kgf/mm$^2$ | Strand elastic modulus tf/mm$^2$ | Composite tensile strength kgf/mm$^2$ | EDS kgf/mm$^2$ |
|---|---|---|---|---|---|---|---|---|---|
| Example 15 | $NH_4HCO_3$ | 100 | 0.4 | 0.08 | 0.02 | 479 | 30.2 | 234 | 24.2 |
| Example 16 | $NH_4HCO_3$ | 200 | 0.3 | 0.09 | 0.04 | 457 | 30.2 | 224 | 25.0 |
| Example 17 | $(NH_4)_2CO_3$ | 100 | 0.5 | 0.08 | 0.03 | 452 | 30.4 | 221 | 23.0 |
| Example 18 | $(NH_4)_2SO_4$ | 100 | 0.5 | 0.10 | 0.02 | 446 | 30.2 | 215 | 20.8 |
| Example 19 | $NH_4NO_3$ | 100 | 0.4 | 0.10 | 0.03 | 450 | 30.2 | 221 | 20.9 |
| Comparison 6 | — | — | 0.2 | 0.03 | 0.01 | 481 | 30.4 | 240 | 10.3 |
| Comparison 7 | Sulfuric acid | 100 | 0.3 | 0.10 | 0.01 | 435 | 30.2 | 221 | 16.7 |
| Comparison 8 | NaOH | 100 | 0.3 | 0.08 | 0.01 | 427 | 30.3 | 216 | 15.9 |

TABLE 5

| Specimen | Sizing component | Number of atoms in longest chain | Mol. wt. | Epoxy eqs. | Amount % | Strand strength kgf/mm$^2$ | Strand elastic modulus tf/mm$^2$ | Composite tensile strength kgf/mm$^2$ | EDS kgf/mm$^2$ |
|---|---|---|---|---|---|---|---|---|---|
| Example 15 | GO-$CH_2$—CH(OG)-$CH_2$-OG | 7 | 260 | 87 | 0.4 | 479 | 30.2 | 234 | 24.2 |
| Example 20 | GO-$CH_2$—CH(OH)-$CH_2$-OG | 7 | 204 | 102 | 0.3 | 476 | 30.3 | 231 | 24.6 |
| Example 21 | GO-$(CH_2CH_2O)_2$-G | 9 | 218 | 109 | 0.3 | 484 | 30.6 | 241 | 24.9 |
| Example 22 | GO-$(CH_2)_6$-OG | 10 | 230 | 115 | 0.4 | 486 | 30.1 | 243 | 23.6 |
| Example 23 | GO-$(CH_2)_{12}$-OG | 16 | 314 | 157 | 0.7 | 489 | 30.2 | 245 | 23.7 |
| Example 24 | GO-$(CH_2CH(CH_3)O)_7$-G | 24 | 536 | 268 | 0.4 | 487 | 30.1 | 252 | 23.7 |
| Example 25 | GO-$(CH_2CH_2O)_9$ -G | 30 | 526 | 263 | 0.5 | 494 | 30.0 | 255 | 24.1 |
| Example 26 | GO-$(CH_2CH(CH_3)O)_9$-G | 30 | 652 | 326 | 0.7 | 493 | 30.2 | 257 | 23.8 |
| Example 27 | GO-$(CH_2CH(CH_3)O)_{17}$-G | 54 | 1116 | 558 | 0.3 | 492 | 30.3 | 257 | 23.9 |
| Example 28 | GO-$(CH_2CH_2O)_{30}$-G | 93 | 1450 | 725 | 0.6 | 490 | 30.2 | 250 | 23.7 |
| Example 29 | GO-$(CH_2CH(CH_3)O)_{69}$-G | 210 | 4132 | 2066 | 0.4 | 491 | 30.1 | 250 | 20.1 |
| Example 30 | $CH_2$—$(OCH_2CH_2)_x$-OG<br>CH—$(OCH_2CH_2)_y$-OG<br>$CH_2$—$(OCH_2CH_2)_z$-OG<br>x = 7, y = 6, z = 7 | 49 | 1140 | 380 | 0.4 | 484 | 302 | 241 | 21.9 |
| Example 31 | $CH_2$—$(OCH_2CH_2)_x$-OG<br>CH—$(OCH_2CH_2)_y$-OG<br>$CH_2$—$(OCH_2CH_2)_z$-OG<br>x = 10, y = 10, z = 10 | 67 | 1580 | 527 | 0.4 | 482 | 30.4 | 237 | 20.4 |
| Comparison 9 | — | — | — | — | — | 477 | 30.2 | 239 | 18.3 |
| Comparison 10 | $CH_3(CH_2)_{11}$-OG | — | 242 | 242 | 0.4 | 482 | 30.0 | 239 | 18.2 |
| Comparison 11 | Epikote 828 | about 13* | 398 | 189 | 0.5 | 484 | 30.2 | 244 | 17.7 |
| Comparison 12 | Epikote 154 | 18–23* | 358 | 179 | 0.4 | 478 | 30.1 | 234 | 18.9 |

*: Aromatic ring counted as 4.
G = $CH_2$—COH—$CH_2$?

TABLE 6

| Specimen | Electrolyte | Current C/g | Amount % | O/C | N/C | Abrasion fluff num/m | Strand strength kgf/mm$^2$ | Composite tensile strength kgf/mm$^2$ | EDS kgf/mm$^2$ |
|---|---|---|---|---|---|---|---|---|---|
| Example 32 | $NH_4HCO_3$ | 100 | 0.8 | 0.10 | 0.02 | 2 | 485 | 240 | 24.1 |
| Example 33 | $(NH_4)_2CO_3$ | 100 | 0.7 | 0.09 | 0.03 | 3 | 478 | 235 | 23.2 |
| Example 34 | $(NH_4)_2SO_4$ | 100 | 0.6 | 0.12 | 0.02 | 5 | 466 | 234 | 20.8 |
| Example 35 | $NH_4NO_3$ | 100 | 0.8 | 0.13 | 0.03 | 4 | 460 | 229 | 21.0 |
| Comparison 13 | Sulfuric acid | 100 | 0.8 | 0.16 | 0.01 | 6 | 445 | 233 | 17.4 |
| Comparison 14 | NaOH | 100 | 0.7 | 0.11 | 0.01 | 3 | 448 | 215 | 16.5 |

TABLE 7

| Specimen | Sizing component | Number of atoms of epoxy/ring | Amount % | Abrasion fluff num/m | Strand strength kgf/mm² | Composite tensile strength kgf/mm² | EDS kgf/mm² |
|---|---|---|---|---|---|---|---|
| Example 36 | 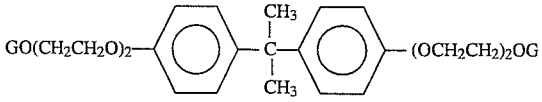 | 8 | 0.8 | 13 | 467 | 225 | 23.3 |
| Example 37 | 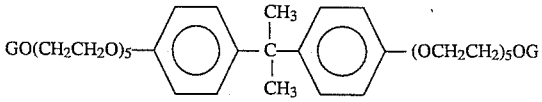 | 17 | 0.8 | 11 | 473 | 230 | 25.1 |
| Example 38 | 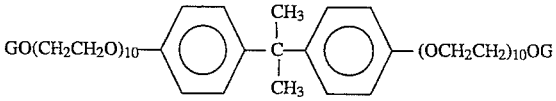 | 32 | 0.8 | 4 | 480 | 236 | 24.6 |
| Example 39 | 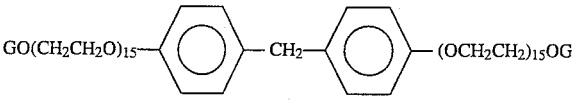 | 47 | 0.8 | 3 | 483 | 234 | 23.1 |
| Example 40 | 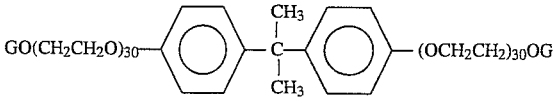 | 92 | 0.8 | 6 | 485 | 239 | 19.5 |
| Comparison 15 | 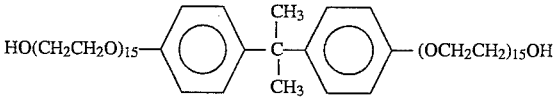 | — | 0.8 | 3 | 480 | 234 | 18.0 |
| Comparison 16 | 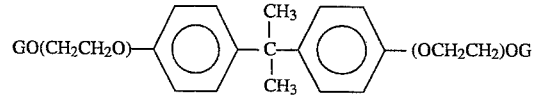 | 5 | 0.8 | 32 | 430 | 207 | 17.4 |

G = $CH_2$ — COH —— $CH_2$,

TABLE 8

| Specimen | Electrolyte | Total current C/g | Sizing component | Solvent | Amount % | Strand strength kgf/mm² | Composite tensile strength kgf/mm² | EDS kgf/mm² |
|---|---|---|---|---|---|---|---|---|
| Example 41 | $NH_4HCO_3$ | 100 | 1,6-naphthalene polyethylene oxide diglycidyl ether | DMF | 0.5 | 475 | 231 | 24.0 |
| Comparison 17 | Sulfuric acid | 100 | 1,6-naphthalene polyethylene oxide diglycidyl ether | DMF | 0.5 | 472 | 239 | 18.2 |

TABLE 9

| Specimen | Resin | Curing temperature °C. | Sizing component | Amount % | Strand strength kgf/mm² | Composite tensile strength kgf/mm² | EDS kgf/mm² |
|---|---|---|---|---|---|---|---|
| Example 1 | A | 130 | Glycerol triglycidyl ether | 0.4 | 484 | 230 | 32 |
| Example 6 | A | 130 | Glycerol diglycidyl ether | 0.4 | 490 | 238 | 33 |
| Example 7 | A | 130 | Polyethylene oxide diglycidyl ether (m in formula [II] = 9) | 0.4 | 491 | 242 | 32 |
| Example 42 | A | 130 | 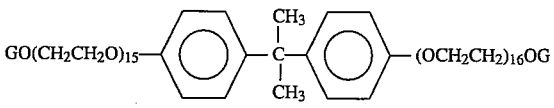 | 0.4 | 485 | 239 | 30 |
| Comparison 2 | A | 130 | — | — | 481 | 231 | 24 |
| Example 43 | B | 180 | Glycerol triglycidyl ether | 0.3 | 484 | 243 | 33 |
| Example 44 | B | 180 | Glycerol diglycidyl ether | 0.4 | 490 | 250 | 33 |
| Example 45 | B | 180 | Polyethylene oxide diglycidyl ether (m in formula [II] =9) | 0.4 | 491 | 254 | 32 |
| Example 46 | B | 180 | 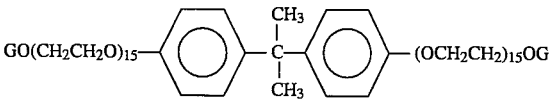 | 0.4 | 485 | 255 | 32 |
| Comparison 18 | B | 180 | — | — | 481 | 245 | 28 |

We claim:

1. A carbon fiber with surface oxygen concentration (O/C ratio) of 0.20 or less as measured by x-ray photoelectron spectroscopy, surface concentration of hydroxyl groups (C—OH/C ratio) of 0.5 to 3.0% as measured by chemical modification x-ray photoelectron spectroscopy and a surface concentration of carboxyl groups (COOH/C ratio) of 2.0 down to 0.2% as measured by chemical modification x-ray photoelectron spectroscopy, and comprising 0.01–10 wt % of an aliphatic compound which has multiple epoxy groups applied as a sizing agent.

2. A carbon fiber with a surface oxygen concentration (O/C ratio) of 0.20 or less as measured by x-ray photoelectron spectroscopy, a surface concentration of hydroxyl groups (C—OH/C ratio) of 0.5 to 3.0% as measured by chemical modification x-ray photoelectron spectroscopy and a surface concentration of carboxyl groups (COOH/C ratio) of 2.0% down to 0.2% as measured by chemical modification x-ray photoelectron spectroscopy, and comprising 0.01–10 wt % of an aromatic compound which has multiple epoxy groups, wherein the number of atoms between the epoxy groups and an aromatic ring is 6 or greater applied as a sizing agent.

3. A carbon fiber according to any one of claims 1–2, wherein the compound has epoxy groups on both ends of the longest atomic chain.

4. A carbon fiber according to any one of claims 1–2 wherein the compound has epoxy groups only on both ends of the longest atomic chain.

5. A carbon fiber according to any one of claims 1 or 2 wherein the epoxy groups are glycidyl groups.

6. A carbon fiber according to claim 1 or 2, wherein the number of atoms on the longest atomic chain of the aliphatic compound with multiple epoxy groups is 20–200.

7. A carbon fiber according to claim 1 or 2, wherein the aliphatic compound with multiple epoxy groups is at least one compound selected from the group consisting of glycerol polyglycidyl ethers, diglycerol polyglycidyl ethers, polyethylene glycol diglycerol polyglycidyl ethers and polypropylene glycol diglycidyl ethers.

* * * * *